US005580174A

United States Patent [19]

Houck

[11] Patent Number: 5,580,174

[45] Date of Patent: Dec. 3, 1996

[54] DRAWER SLIDE ASSEMBLY

[75] Inventor: Peter J. Houck, Tulare, Calif.

[73] Assignee: Houck Industries, Inc., Greensburg, Ind.

[21] Appl. No.: 113,270

[22] Filed: Aug. 27, 1993

[51] Int. Cl.[6] ..... F16C 29/04

[52] U.S. Cl. ..... 384/19

[58] Field of Search ..... 384/19, 58, 21, 384/23, 47

[56] References Cited

U.S. PATENT DOCUMENTS

| | | | |
|---|---|---|---|
| 2,627,447 | 3/1953 | Cook . | |
| 2,857,233 | 10/1958 | Reiss . | |
| 2,860,929 | 11/1958 | Gussack . | |
| 3,701,577 | 10/1972 | Fischer . | |
| 3,784,274 | 1/1974 | Holmes et al. . | |
| 3,929,386 | 12/1975 | Read . | |
| 4,025,138 | 5/1977 | Kittle . | |
| 4,387,942 | 6/1983 | Lense . | |
| 4,601,522 | 7/1986 | Röck | 384/19 |
| 4,863,288 | 9/1989 | Houck . | |
| 5,244,284 | 9/1993 | Larson et al. | 384/58 |

*Primary Examiner*—Lenard A. Footland
*Attorney, Agent, or Firm*—Barnes & Thornburg

[57] ABSTRACT

A drawer slide assembly includes a track member mounted to a cabinet frame and a bracket mounted to the side wall of a drawer. The track member includes a track roller axially mounted thereon, and a longitudinally extending channel. The bracket includes a bracket roller axially mounted thereon and a longitudinally extending groove. The bracket roller is received in the channel on the track and is substantially surrounded on three sides by the channel. The track roller has a periphery having a cross-section similar to that of a truncated cone, and the groove is substantially V-shaped. The track roller rides in the groove such that the slant sides of the roller are received on the opposing sides.

14 Claims, 5 Drawing Sheets

DRAWER SLIDE ASSEMBLY

BACKGROUND AND SUMMARY OF THE INVENTION

The present invention is related generally to slides for mounting drawers in cabinets or other furniture. More particularly, the present invention is related to drawer slides which mount on the sides of the drawer.

Drawers which are housed in cabinets, desks, or other pieces of furniture can be used to provide easy access and storage for innumerable items. Repetitive opening and closing of drawers, however, is difficult unless a drawer slide or similar device is used to facilitate movement of the drawer. Without such a drawer slide assembly, the tolerances between the drawer and the cabinet must be maintained at levels too precise for common manufacture.

Thus, drawer slide assemblies were created to facilitate the opening and closing of a drawer from a cabinet. Several types of drawer slide arrangements are known. One type uses two drawer slides, one mounted on each opposite side of the drawer. Brackets are mounted on each side of the drawer, and engage a track member or bracket which is mounted adjacent the drawer bracket to the cabinet. In other arrangements, a single drawer slide assembly is used. A bracket is centrally mounted to the bottom of the drawer, which engages a bracket or track member mounted to the cabinet frame.

Drawer slide assemblies can also be distinguished by the manner in which the drawer bracket interacts with the cabinet bracket. For example, the bracket mounted to the drawer may include a bearing surface thereon, which contacts and slides directly on a portion of the bracket mounted to the cabinet. Other known drawer slide assembly arrangements have used a wheel or roller which is mounted to one of the brackets, and rolls within a track or groove in the opposite bracket.

Several problems accompany the use of known drawer slide arrangements. For example, when a drawer is opened or closed, the user seldom pulls or pushes the drawer precisely straight out or in. Typically, the user will lift up or pull down on the drawer slightly, as well as open and close the drawer at an angle from the vertical. These various vertical and horizontal forces which are exerted by the user onto the drawer can cause the drawer slide assembly to bend or twist. This can ruin the precision of the tracking assembly. Thus, it is desired to have a drawer slide assembly which prevents and limits the effects of horizontal and vertical forces which may be applied to the drawer.

Another problem faced by known drawer assemblies concerns the interaction of the drawer bracket with the cabinet bracket. Because of manufacturing tolerances, certain surface irregularities are likely to occur in the rail or track members. If the area of contact between the wheel and rail is reduced, the effects of the surface irregularities are also reduced. Thus, a roller or wheel assembly was developed to avoid the effects of surface irregularities. However, known roller or wheel bearing assemblies also face problems due to surface irregularities. This is particularly so when the roller or wheel "bottoms-out" or "tops-out" in the groove or channel in which it rides. If the periphery of the wheel rides flush against the channel or groove, the wheel will contact every such surface irregularity in the channel. This produces a "bumpy ride", and the drawer will not easily open and close.

The problems of surface irregularities in wheel or roller bearing drawer slide assemblies are further accentuated over time. After prolonged use, the surface of the roller will wear. As the surface of the roller or wheel wears, its area of contact within the channel or groove may significantly increase. If the contact area between the roller and the channel decreases, the arrangement will become less stable.

A drawer slide assembly which limits and reduces the effects of vertical and horizontal forces applied to the drawer when the drawer is opened and closed would be welcomed in the industry. A drawer slide assembly which reduces the effects of surface irregularities in the drawer bracket and cabinet bracket components would offer many advantages over conventional assemblies. Also, a drawer slide assembly which maintains its stability and solid feel over time and after repetitive use would be well-received.

According to the present invention, a drawer slide includes a pair of track members attached to the cabinet frame and corresponding brackets attached to the side walls of the drawer. Each track member is a generally elongated body having a track roller axially mounted at one distal end. The track roller is specifically designed to be received within a groove formed in the bracket. The perimeter of the track roller has a cross-sectional configuration similar to that of a truncated cone. The track roller includes opposing slants, which transition to meet along a bottom surface, thus forming the perimeter of the wheel.

The track member is formed to include a channel extending longitudinally therein. The channel is substantially rectangular in shape, and includes one side wall, one top wall, and one bottom wall. Thus, the channel is substantially enclosed on three sides.

The bracket is also a generally elongated member and includes a bracket roller adjacent one distal end. The bracket roller is axially mounted to the bracket and allowed to rotate freely. The bracket roller has a cross-sectional configuration substantially rectangular in shape and is receivable within the channel on the track member. The cross-sectional dimensions of the bracket roller are slightly less than the dimensions of the channel, such that the wheel may roll therein, but is closely bordered by the top, bottom, and side walls of the channel.

The bracket member is also formed to include a longitudinally extending groove therein. The groove is substantially V-shaped and is dimensioned to receive the track roller therein. Once mounted, the track member and the bracket are positioned adjacent to one another such that the groove in the bracket is substantially above the track roller.

As the drawer is opened and shut, the track roller rolls along the groove in the bracket and the bracket roller rides in the channel in the track member. The slant surfaces of the track roller contact the side walls of the V-shaped groove such that the bottom surface of the track roller does not contact the groove. This provides an angled surface of contact. Vertical forces exerted on the drawer produce resultant vertical and horizontal components and horizontal forces exerted on the drawer produce vertical and horizontal resultant forces. Thus, the effects of vertical and horizontal forces are reduced.

By reducing the effects of vertical and horizontal forces between the door and the cabinet frame, the objects of the invention are achieved. The precision of the tracking assembly is maintained, because the horizontal and vertical forces supplied by the user are reduced. Furthermore, the problems surrounding surface irregularities caused by manufacturing tolerances are reduced, because the area of contact of the rollers within their respective tracks or grooves is reduced, and maintained at a more constant area. These features produce a drawer slide assembly which allows for easy insertion and removal of a drawer from a cabinet frame, and provides a solid "feel" over an extended period of usage.

Additional objects, features, and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figures 1, 1A, 2:
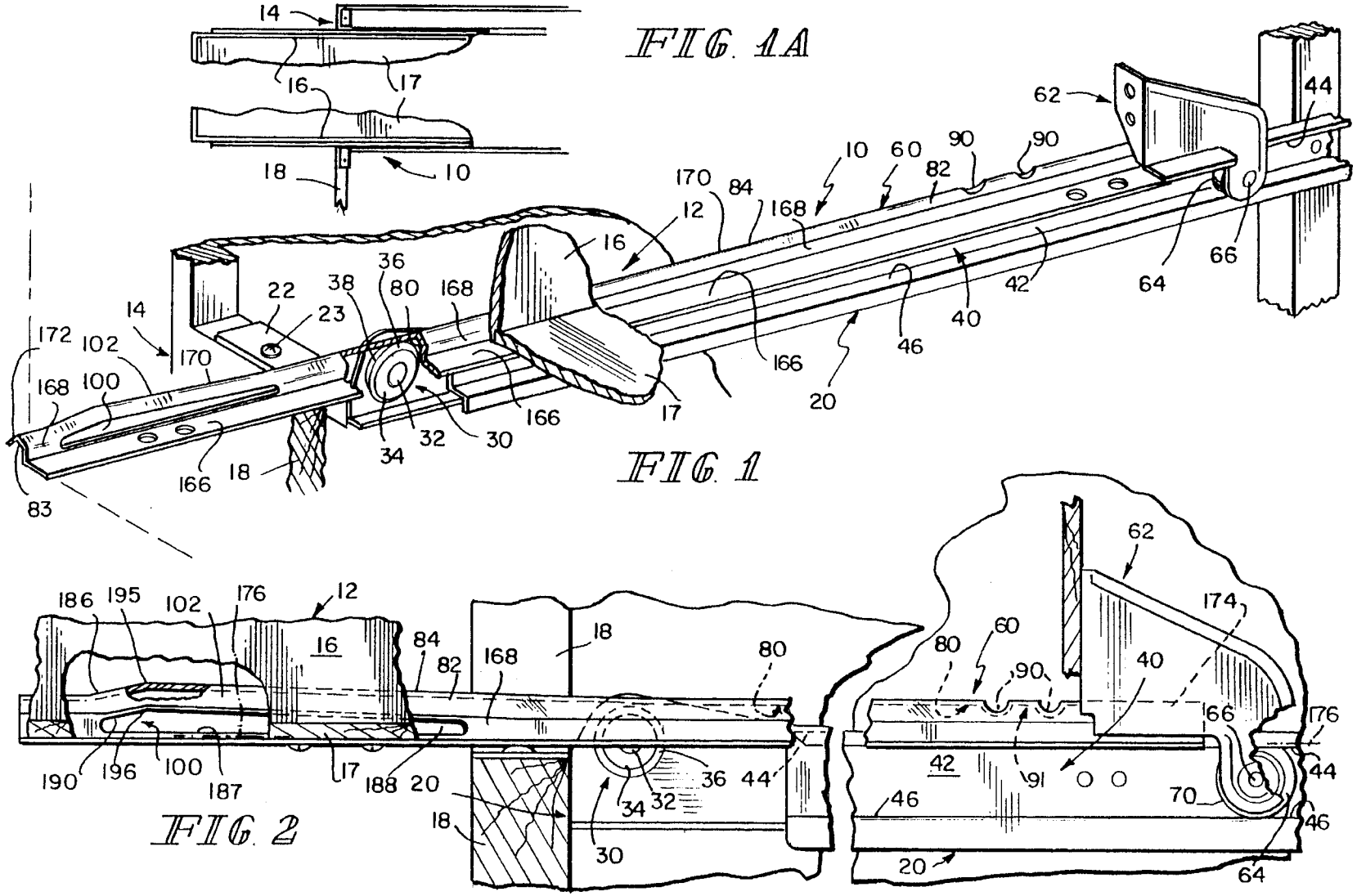
FIG. 1 is a perspective view of a drawer slide assembly according to the present invention.
FIG. 1A is a plan view of a drawer within a cabinet utilizing a drawer slide assembly according to the present invention.
FIG. 2 is a side view of a drawer slide assembly shown in FIG. 1.

Referring now to the drawings, drawer slide assembly 10 is shown mounted to drawer 12, as in FIGS. 1 and 1A. As shown, drawer 12 includes a drawer slide assembly 10 mounted to each opposing sidewall 16 of drawer 12. Thus, a typical drawer 12 includes two drawer slide assemblies 10. This can be seen in FIG. 1A. However, the scope of the present invention is not to be limited by the number of drawer slide assemblies 10 used in conjunction with a single drawer 12.

Drawer slide assembly 10 is attached to drawer 12 and cabinet 14. Typically, drawer 12 includes opposing side walls 16 which extend substantially vertically and a horizontal bottom wall 17 extending between spaced-apart side walls 16. Cabinet 14 includes frame 18 in which drawer 12 is slidably disposed. The present invention is intended for use under generally light-weight conditions, such as in drawers used in residential kitchens. However, the scope of the present invention is not to be limited by the type of drawer or cabinet in which drawer slide assembly 10 is used.

Drawer slide assembly 10 includes two components such as track member 20 and bracket 60. Track member 20 is attached to cabinet frame 18 and bracket 60 is attached to drawer 12. The two components 20, 60 are mounted so as to be disposed adjacent one another as drawer 12 slides in and out of cabinet 14. The track member 20 and bracket 60 interact with one another as drawer 12 is pulled out of, or pushed into, cabinet 14. This interaction can be seen in FIGS. 1 and 2. It is the interaction of track member 20 with bracket 60 which eases the insertion and removal of drawer 12 from cabinet 14, and which produces a solid "feel" to the user. The interaction of track member 20 and bracket 60 also reduces the vertical and horizontal forces applied to drawer 12 by a user. Drawer 12 includes a bracket 60 mounted thereto on each side wall 16 and cabinet frame 18 includes a corresponding track member 20 for each such bracket 60. The mounting positions of these two components may be reversed such that track member 20 may be mounted to drawer 12 and bracket 60 may be mounted to cabinet 14.

Track member 20 is a generally elongated member, extending substantially the entire length of cabinet frame 18. Track member 20 is preferably constructed of a sturdy, rigid light-weight material, which is able to withstand repetitive use. A material suitable for use in the construction of track member 20 is steel. Track member 20 may be plated to enhance its appearance or may be finished with an organic coating.

Track member 20 includes face frame mount 22 adjacent one end of track member 20 as shown in FIG. 1. Face frame mount 22 provides a means for mounting track member 20 to cabinet frame 18. A plurality of holes are formed in face frame mount 22 allowing track member 20 to be attached to cabinet frame 18 by screws 23, nails, or other suitable connectors.

A rotatable track roller 30 is positioned on track member 20 to lie adjacent to face frame mount 22, as shown in FIGS. 1 and 2. Track roller 30 may be formed of injection molded plastic. However, it should be noted that track roller 30 could be constructed of other materials. Track roller 30 is mounted to track member 20 in a substantially vertical position, as shown in FIGS. 1 and 2, such that the axis of rotation of track roller 30 is substantially orthogonal to the longitudinal axis of track member 20. Track roller 30 is rotatably mounted to track member 20 on axle 32 and is free to spin about the axle 32.

Track roller 30 is configured and arranged to provide a "floating" wheel assembly. That is, track roller 30 is deliberately mounted to allow for some lateral or side-to-side movement with respect to track member 20. The amount of lateral play provided track roller 30 may be varied, but it is preferred to be at least approximately 3/32 of an inch. The use of this "floating" wheel assembly compensates for tolerance inaccuracies between drawer 12 and cabinet frame 18, and eliminates the need for shims in most instances. Reference is hereby made to U.S. Pat. No. 4,863,288 issued to Houck and entitled "Floating Wheel Drawer Slide" for a complete description of a suitable "floating" wheel assembly.

Figure 3:
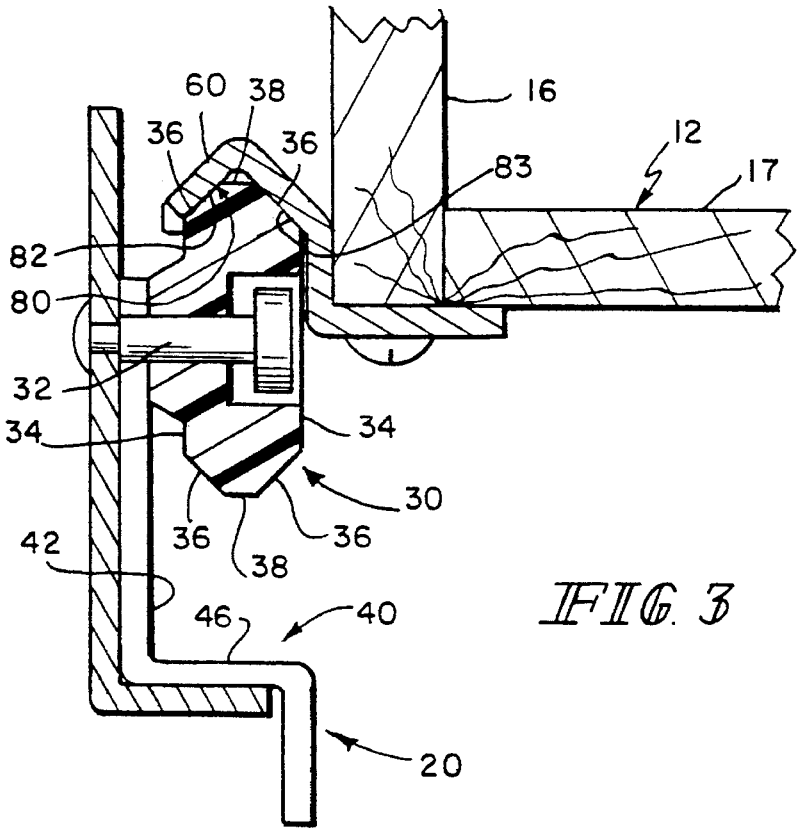
FIG. 3 is a substantially dead sectional view taken along lines 3—3 of FIG. 6 slide assembly showing the relative position of the track roller within the groove.

Each track roller 30 is specifically designed to be received in a groove 80 formed in bracket 60 and to rotate about its axis of rotation as drawer 12 and bracket 60 are moved into and out of cabinet 14. As can be seen in FIG. 3, track roller 30 includes opposing faces 34, which extend substantially vertically, orthogonally to the axis of rotation of the track roller 30. As each face 34 approaches the perimeter of track roller 30, the face transitions at an angle, inward toward the vertical, to slant 36. Each slant 36 transitions to apex 38, which is substantially horizontal, or parallel to the axis of rotation of track roller 30. The periphery of the track roller 30, formed by opposing slants 36 and apex 38, thus has a cross-section similar to that of a truncated cone, as shown in FIG. 3. As shown, each slant 36 transition from face 34 at an angle of approximately 45° from the vertical. However, it should be well understood that the scope of the present invention is not limited by the angle of slant 36.

Referring again to FIGS. 1 and 2, track member 20 is also formed to include channel 40 which extends longitudinally along the track member 20. Channel 40 extends substantially the entire length of track member 20 and is designed to receive a wheel or roller 64 which is mounted onto bracket 60. Channel 40 generally includes side wall 42, top wall 44, and bottom wall 46. Side wall 42 extends substantially vertically, parallel to the vertical alignment of track roller 30. Top wall 44 extends from the top edge of side wall 42, substantially orthogonal to the side wall 42. Bottom wall 46 extends in a similar fashion, orthogonally from the bottom edge of side wall 42. Side wall 42, top wall 44, and bottom wall 46 combine to form channel 40, which is generally of a rectangular cross-section and which is substantially enclosed on three sides. Bottom wall 46 and top wall 44 may also include a lip (not shown) thereon. A lip on top wall 44 would extend substantially orthogonally to the top wall and downwardly towards bottom wall 46. Such a lip extending from bottom wall 46 would be substantially orthogonal to the bottom wall, extending towards top wall 44.

Bracket 60 is also a generally elongated member and extends substantially the entire length of drawer side wall 16. Bracket 60 is constructed of a sturdy, rigid light-weight material, as is track member 20, and is able to withstand repetitive use. A material suitable for use in the construction of bracket 60 is steel. Bracket 60 may be plated to enhance its appearance, or may be finished with an organic coating.

Figure 9:
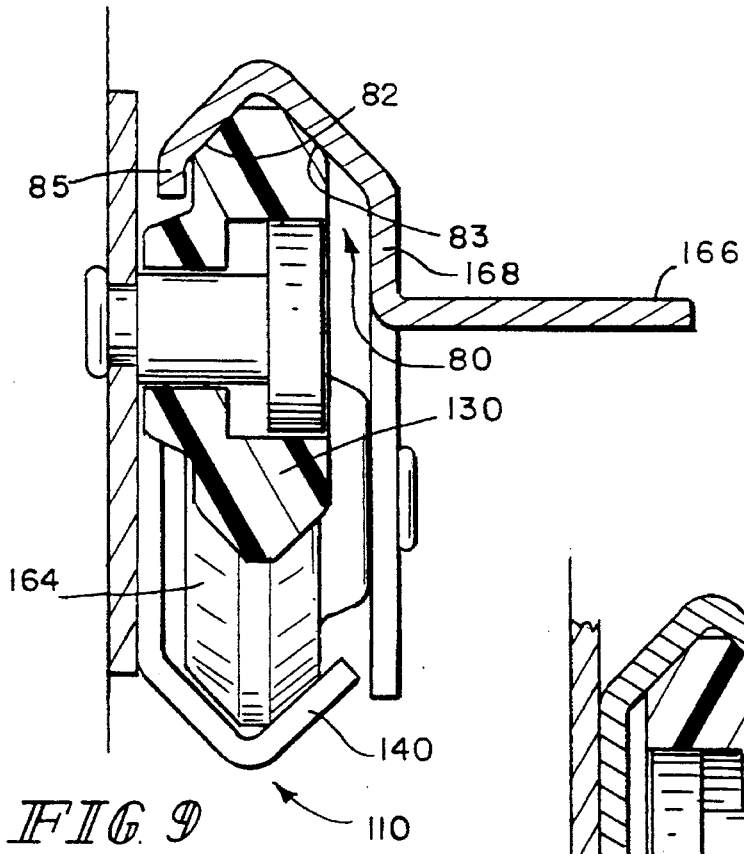
FIG. 9 is a cross-sectional view of a second illustrative embodiment of a drawer slide assembly of the present invention, showing the assembly loaded to one side during use.

As shown in FIG. 1, the drawer bracket 60 is nested within cabinet track member 20 and includes a bottom support 166 formed for attachment to the substantially horizontal bottom wall 17 of the drawer 12. Additionally a side wall 168 is formed to be positioned adjacent the side wall 16 of the drawer 12 and to extend between the bottom support 166 and an upper track roller retaining portion 170. As shown in FIG. 9, the track roller retaining portion 170 includes two slanted walls 82, 83 which define the groove 80. The track roller 30 is formed for rotating movement within the groove 80 and engages the two slanted walls 82, 83 defining said groove 80. See for example, FIGS. 9 and 11. Additionally, as shown in FIG. 9, the slanted wall 82 includes a blocking tab 85 extending in a substantially downwardly vertical direction to prevent the track roller 30 from jumping out of the groove 80.

Figure 6:
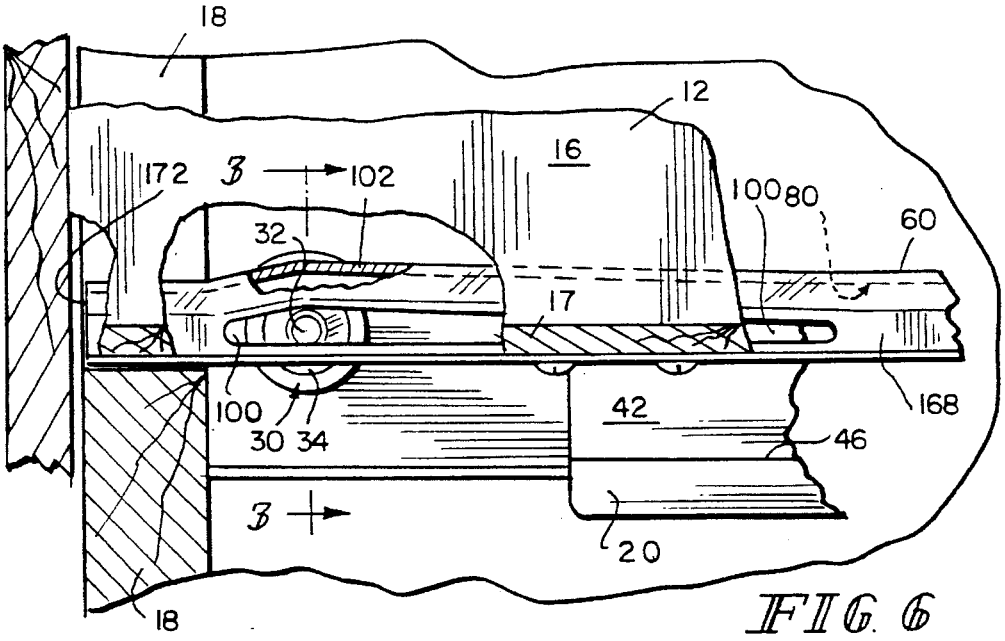
FIG. 6 is a partial side view of a drawer slide assembly of FIG. 1 showing the drawer in a nearly closed position.
Figure 7:
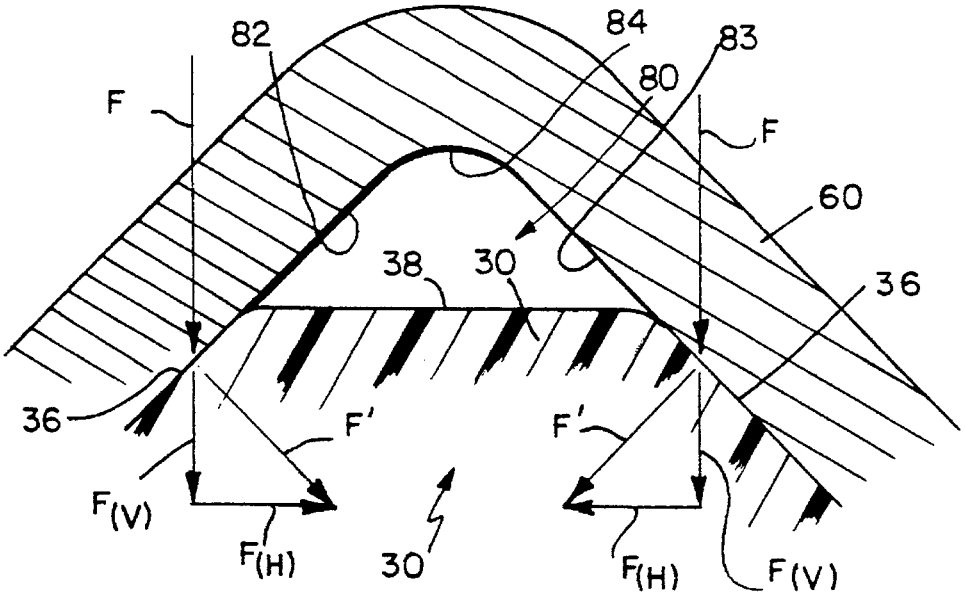
FIG. 7 is a cross-sectional view of a roller of the present/invention within a track or bracket of the present invention, showing typical vertical forces exerted between the track and the roller.

The slanted walls 82, 83 abut and glide on the track roller 30 between a fully open position (see FIG. 5) and a fully closed position (see FIG. 6) relative to the cabinet track member 20 so that the weight of the drawer 12 will be distributed to the inclined rolling surface 36 on the track roller 30 to be vertically applied to the horizontal axle 32 to be supported by the cabinet 14. In the fully open position, (see FIG. 5) the track roller 30 lies adjacent the outer side 172 of the drawer bracket 60. Moreover, in the fully dosed position, (see FIG. 6) the track roller 30 lies adjacent the inner side 174 of the drawer bracket 60. As shown in FIG. 7, the slanted walls 82, 83 are positioned so that the vertex 84 is positioned in a horizontal plane 176 (see FIG. 2) on the drawer bracket member 60 substantially parallel to the horizontal drawer bottom 17 at the inner side 174 and the outer side 172 of the drawer bracket member 60.

A bracket mount 62 is provided at an outer end of bracket 60. Bracket mount 62 has a plurality of holes therein, allowing the bracket 60 to be mounted to drawer 12. Screws, nails, or similar connectors (not shown) may be used to secure bracket mount 62 to drawer 12. Adjacent bracket mount 62, bracket 60 includes bracket roller 64. Bracket roller 64 is shown, for example, in FIGS. 1, 2, and 4. Bracket roller 64, like track roller 30, may be formed of injection molded plastic and is mounted to bracket 60 by axle 66. Bracket roller 64 is mounted to bracket 60 in a substantially vertical position such that the axis of rotation of bracket roller 64 is substantially orthogonal to the longitudinal axis of bracket 60. Like track roller 30, bracket roller 64 is preferably a "floating" wheel assembly, mounted on bracket 60 to allow for some lateral movement.

Figure 4:
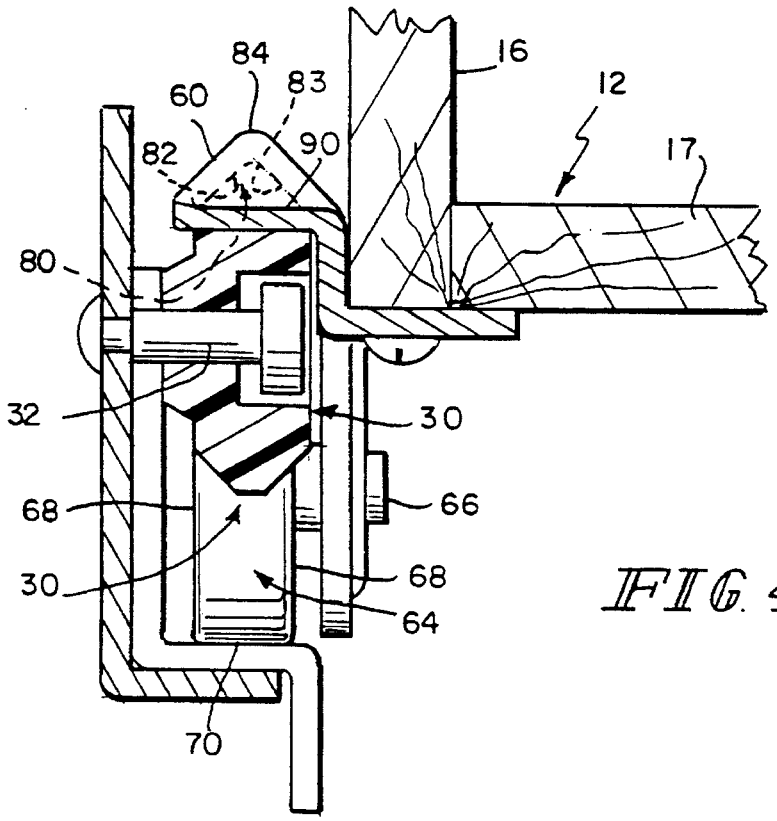
FIG. 4 is a cross-sectional view taken along lines 4—4 of FIG. 5 of a drawer slide assembly showing the relative positioning of the bracket roller in the channel.

Bracket roller 64 is designed to be received within and ride along channel 40 of track member 20 as drawer 12 and bracket 60 are moved into and out of cabinet 14. As can be seen in FIG. 4, bracket roller 64 includes opposing faces 68 which extend substantially vertically and orthogonally to the longitudinal axis of roller 64. At the perimeter of the wheel, each opposing face 68 transitions substantially orthogonally, to form bearing surface 70. Thus, the cross-sectional configuration of bracket roller 64 is substantially rectangular in shape.

Bracket roller 64 is designed to be received within channel 40, while allowing for slight tolerances. Bracket roller 64 is trapped, or captured at its top and bottom, against top wall 44 and bottom wall 46, respectively.

Bracket 60 is also formed to include a groove 80 therein as shown in FIGS. 1, 2 and 3. Groove 80 extends generally longitudinally, substantially from bracket mount 62 to the opposite distal end of bracket 60. Groove 80 is substantially V-shaped, having opposing oblique walls 82, which meet along vertex 84. In the illustrative embodiments, oblique walls 82 are angled from the vertical at an angle of approximately 45°. When bracket 60 is mounted to drawer 12, groove 80 is positioned such that vertex 84 is substantially vertically above oblique walls 82, and thus groove 80 opens vertically downwardly, forming an inverted "V", as shown in FIG. 3.

Groove 80 is designed to receive track roller 30 therein. As shown in FIG. 3, groove 80 is positioned vertically above track roller 30, such that roller 30 contacts groove 80 from below bracket 60. Track roller 30 contacts groove 80 along slants 36, and not along apex 38. Opposing slants 36 contact and ride flush against oblique walls 82, but apex 38 does not contact vertex 84. Thus, track roller 30 does not "bottom-out" or "top-out" against groove 80.

Figure 5:
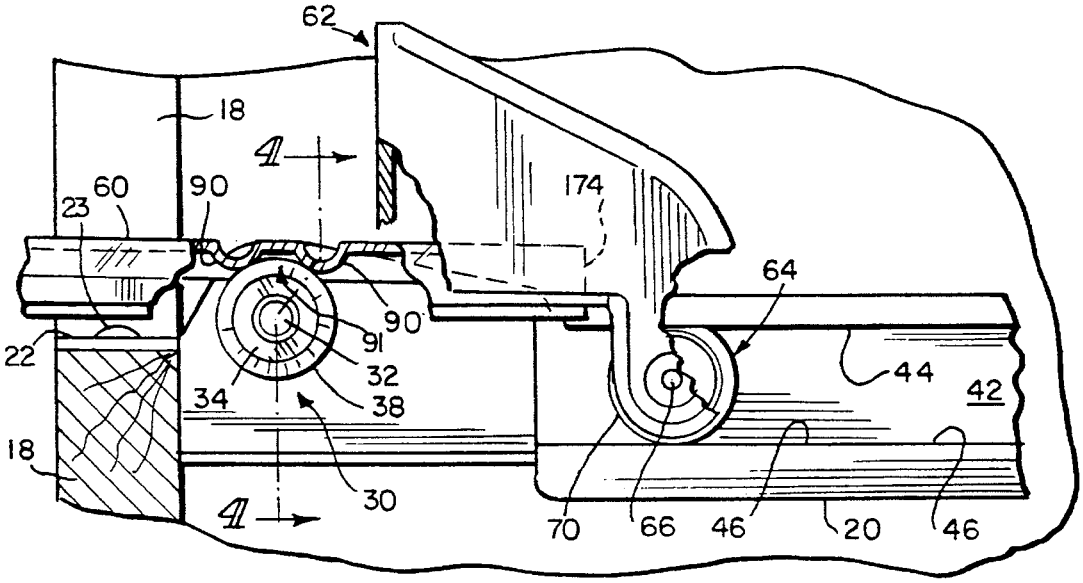
FIG. 5 is a view showing the drawer in a fully opened position.

Adjacent bracket mount 62, groove 80 includes a pair of spaced detents 90 therein, as can be seen in FIG. 5. Detents 90 project from vertex 84 down into groove 80. Detents 90 are spaced apart such that track roller 30 may be positioned in space 91 provided therebetween. When track roller 30 is positioned between detents 90, the track roller 30 is essentially "locked" in position. An additional force is required to be exerted by the user to dislodge track roller 30 from the trapped position in space 91 between detents 90.

As best shown in FIG. 5, the detents 90 locate the drawer bracket member 60 in a secure position on the cabinet track member 20 and thus the bracket roller 64 is prevented from engaging the track roller 30 when the drawer bracket member 60 moves to the fully open position.

The inner end of bracket 60 if formed to include slot 100. This can be seen in FIG. 6. Slot 100 provides drawer slide assembly 10 with an expandable metal feature. Note, the vertical side wall 168 supports the slanted side wall 83 and the slot 100, as shown in FIGS. 1 and 6, extends through the side wall 168. The slot 100 is positioned vertically below the ramp 102. The slot 100 is generally triangular in shape. After bracket 60 is initially formed, a force is applied to bracket 60 to form ramp 102. Ramp 102 is an inclined portion of groove 80, opposite detents 90 as shown in FIG. 2.

The ramp 102, shown in FIG. 2, has its left end angled upwardly from the normal plane 176 to a high point to cause a camming action between the slanted walls 82, 83 and the track roller 30 so that the front end of the drawer 12 is automatically guided downwardly and toward its dose position on the track roller 30 as the bracket member 60 presses over the track roller 30 starting at the inner portion of the ramp 102 as shown in full line in FIG. 2. Continuing to refer to FIG. 2, the ramp 102 includes an inclining portion 184 formed to vertically lower the drawer bracket member 60 relative to the cabinet track member 20 and a declining portion 186 formed to block the natural movement of the drawer bracket member 60 sliding toward the fully dosed position (see FIG. 6). The ramp 102 further includes a peak 195 positioned vertically above the horizontal plane 176, refer again to FIG. 2. Note, FIG. 2 further illustrates the vertical side wall 168 being formed to include a lip 187 extending about the perimeter of the slot 100. The lip 187 includes a first side 188 substantially parallel to the inclining portion 184, an apex 196 positioned vertically below the peak 195, and a second side 190 substantially parallel to the declining portion 186 of the ramp 102. When a force is applied to groove 80, bracket 60 is allowed to form ramp 102 without otherwise disfiguring the bracket due to slot 100. Thus, bracket 60 remains elongate and true, while allowing for the formation of ramp 102.

Thus, the generally V-shaped groove 80 provides a means for insuring that drawer 12 will remain fully open or fully closed. When drawer 12 is in the fully open position, as can be seen in FIG. 5, track roller 30 rests substantially in space 91 between detents 90. The opposing detents 90 contact track roller 30, and substantially prevent track roller 30 from rolling in groove 80. Thus, drawer 12 will not inadvertently close. To close the drawer, a force must be applied such that track roller 30 may overcome the resistance of detents 90. As drawer 12 nears the fully closed position, track roller 30 engages ramp 102 in groove 80, shown in FIG. 6. Ramp 102 naturally guides track roller 30 until roller 30 is received at the base of ramp 102. In this position, drawer 12 is fully closed. This insures that drawer 12 will not be inadvertently left in a partially open position.

When drawer 12 is closed, and rests substantially within cabinet frame 18, the weight of the drawer and items therein exert a vertical force through bracket roller 64 onto channel 40 of track member 20. This causes bracket roller 64 to rest against bottom wall 46 of channel 40. The tolerance or distance between the top of bracket roller 64 and top wall 44 is minimal. As bracket roller 64 exerts a downward force onto bottom wall 46, groove 80 also exerts a downward force onto track roller 30. Thus, the weight of drawer 12, and the items therein, is shared by bottom wall 46 and track roller 30.

As drawer 12 is pulled out, bracket roller 64 rolls along bottom wall 46 of channel 40, and track roller 30 rolls within groove 80. If the drawer is lifted upwardly as it is pulled out, groove 80 will be lifted from its engagement with track roller 30. Drawer 12 will then be in a slightly angled position, such that the remaining load of the drawer is distributed by bracket roller 64 along bottom wall 46 of channel 40. The tight fit of bracket roller 64 within channel 40 limits the amount of vertical play, or movement, of drawer 12 as it slides in and out cabinet 14. Thus, if the user slightly lifts the drawer when sliding it in and out, the user will not notice this shift in contact. The drawer will continue to produce a solid "feel" and sound to the user.

As drawer 12 is retracted from cabinet frame 18, the effect of the vertical forces exerted by the drawer on the cabinet change. Portions of drawer 12 which extend out of cabinet frame 18 are no longer vertically supported. When drawer 12 is opened half-way, or when half the weight of the drawer and items therein extend outside of cabinet frame 18, the forces on track member 20 and bracket 60 shift. The weight of drawer 12 outside of cabinet frame 18 causes the drawer to pivot. Track roller 30 acts as the pivot point, and thus much of the downward force of drawer 12 is shifted to track roller 30. Bracket roller 64 pivots vertically upward, contacting top wall 44 of channel 40. Again, because the tolerance between bracket roller 64 and channel 40 is small, the user does not bear the weight or feel the shifting of weight as the drawer is opened.

As drawer 12 is opened and closed, groove 80 exerts a downward force upon track roller 30. More specifically, opposing oblique walls 82 on groove 80 exert a force on slants 36 of track roller 30. Because of the angle at which oblique walls 82 contact slants 36, the resultant force exerted on track roller 30 includes a vertical component and a horizontal component.

As shown in FIG. 7, Force F is exerted by oblique wall 82 onto slants 36. The resultant force F' can be divided into vertical and horizontal components, F(V) and F(H), respectively. Because of the angled design of oblique walls 82 and slants 36, the resultant vertical force, F(V) is less than the initial vertical force F, the weight of drawer 12. Thus, the weight of the drawer is evenly distributed among both vertical and horizontal components, and the drawer is able to slide in and out of cabinet 14 with ease. In embodiments shown, where oblique walls 82 and slants 36 are angled approximately 45° from the vertical, the resultant vertical force is approximately $\sqrt{1/2}$ of force F.

The interface of oblique walls 82 and slants 36 also reduces the effects of external lateral forces which may be applied to drawer 12. In prior drawer slide designs, if a user pulled the drawer open from some angle to the vertical, the wheels or rollers would bind up against the tract. The friction caused between the roller and the track would reduce the free-rolling motion of the roller, and would make the drawer difficult to open. This problem is reduced by the design of the present invention.

Figure 8:
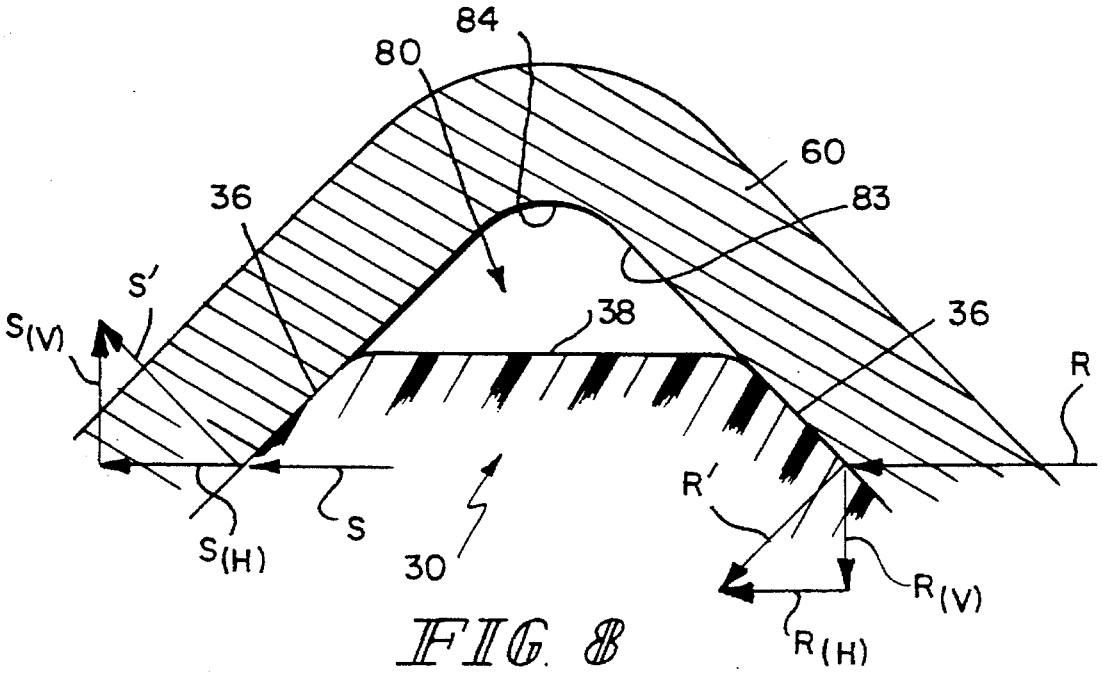
FIG. 8 is a cross-sectional view of a roller of the present invention and a track or bracket of the present invention, showing typical horizontal or lateral forces applied from the track to the roller and the roller to the track.

A lateral force applied to drawer 12 includes force R applied from oblique wall 82 to slant 36, and force S exerted from the opposite slant 36 to opposite oblique wall 82. This is shown in FIG. 8. Both forces R and S yield resultant forces, shown as R' and S'. The resultant forces have vertical and horizontal components, indicated as R(V), R(H), S(V), and S(H), respectively.

Due to the angled design, the total lateral forces applied to drawer 12, R and S, are reduced to R(H) and S(H). In the embodiments shown, where oblique walls 82 and slants 36 are angled at approximately 45° from the vertical, the magnitude of the resultant forces R(H) and S(H) are approximately $\sqrt{1/2}$ of the magnitude of forces R and S. This reduction in the horizontal forces allow drawer 12 to easily slide in and out of cabinet frame 18, even if the drawer is not pulled straight out. The result is a drawer which feels and sounds solid to the user.

The angled design of the present invention also advantageously provides for the self-alignment of track roller 30 within groove 80. As track roller 30 rolls along groove 80, slants 36 will wear over time. However, as slants 36 rides substantially flush against oblique walls 82, the wear will be substantially uniform. Furthermore, as each opposing slant 36 wears, the area of contact between the slant and its corresponding oblique wall remains substantially constant. As the contact area does not substantially increase, track roller 30 does not contact additional surface irregularities in groove 80 over time. As the contact area does not substantially decrease, track roller 30 remains stable and captured between opposing oblique walls 82.

Figure 10:
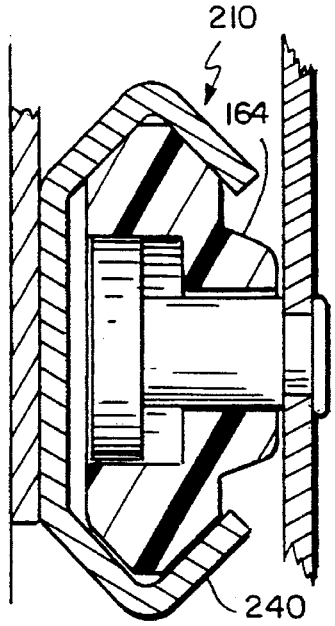
FIG. 10 is a cross-sectional view of the assembly of FIG. 9 showing engagement of the bracket roller in the channel.
Figure 11:
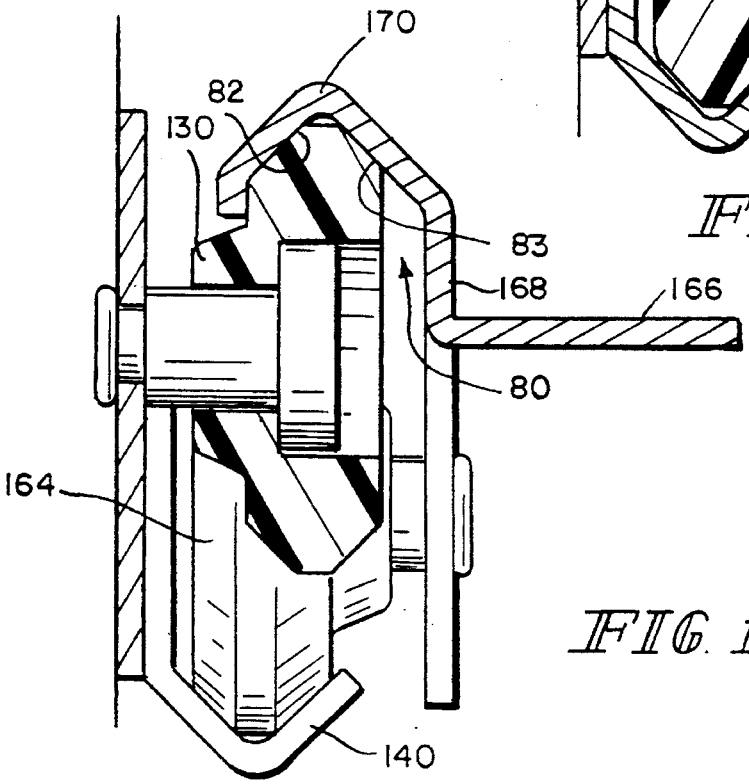
FIG. 11 is a cross-sectional view of the assembly of FIG. 9 showing the assembly loaded to the opposite side during use.

FIGS. 9–11 show a second illustrative embodiment of the present invention. In this embodiment, bracket roller 164 has a cross-sectional design similar to that of track roller 30. The perimeter, or periphery of bracket roller 164 is similar to that of a truncated cone. Bracket roller 164 rolls along channel 140, such that the slant portions of the track roller contact the oblique walls of channel 140, and the track roller does not "bottom out" or "top-out" within channel 140.

FIG. 9 shows drawer slide assembly 110 when it is loaded to one side. In this extreme position, track roller 130 and bracket roller 164 are laterally offset. FIG. 10 shows bracket roller 164 trapped along both its top and bottom by channel 140. Bracket roller 164 is substantially captured by the channel, and thus provides a solid "feel" to the user.

FIG. 11 shows the second illustrative embodiment of the present invention when it is loaded to the opposite side. In this orientation, bracket roller 164 and track roller 130 are more closely aligned, such that the line of travel of track roller 130 is nearly linear to the line of travel of bracket roller 164.

Although the invention has been described in detail with reference to preferred embodiments and specific examples, variations and modifications exist within the scope and spirit of the invention as defined in the following claims.

I claim:

1. A drawer slide assembly for horizontally guiding the opening and closing of a drawer from a cabinet comprising an elongated cabinet track member for attachment on a side wall of a cabinet, the cabinet track member including a track roller for fixedly attaching to the cabinet side wall so as to be supported by and rotatable about a horizontal axle, and an elongated drawer bracket member for attachment on the drawer and nested within the elongated cabinet track member, the drawer bracket member including an inner side, an opposite outer side, and slanted walls transitioning to a vertex to form a groove receiving the track roller and extending between the inner and outer sides of the elongated drawer bracket, and the slanted walls of the drawer bracket member being formed to abut and glide on the track roller between a fully closed and a fully open position relative to the cabinet track member so that the weight of the drawer will be distributed to the track roller by the slanted walls to be vertically applied to the horizontal axle so as to be supported by the cabinet.

2. The assembly of claim 1, Wherein drawer bracket member is formed to include a ramp positioned adjacent one of the opposite sides, the ramp being formed to raise the vertex and slanted walls above their normal level at both ends of the drawer bracket member so that the drawer bracket member is naturally guided on the track roller downward and is automatically moved to a closed position as the track roller begins to traverse the ramp portion as the drawer bracket is moved toward its closed position.

3. The assembly of claim 2, wherein the ramp also includes a declining portion formed to block the natural movement of the drawer bracket member sliding toward the fully closed position.

4. The assembly of claim 3, wherein ramp is positioned adjacent the inner side of the drawer bracket member.

5. The assembly of claim 3, wherein the drawer bracket member includes a vertical side wall supporting one of the slanted side walls and the vertical side wall is formed to include a slot positioned vertically below the ramp of the bracket member.

6. The assembly of claim 5, wherein the vertical side wall is formed to include a lip extending about the perimeter of the slot, the lip having a first side substantially parallel to the ramp and a second side substantially parallel to the declining portion of the ramp.

7. The assembly of claim 2, wherein the drawer bracket includes a pair of spaced detents extending downward into the groove adjacent a side of the drawer bracket spaced away from the ramp portion and wherein the detents are spaced-apart so that the track roller may be positioned therebetween to locate the drawer bracket member in a secure position on the cabinet track member when the drawer is in its open position.

8. The assembly of claim 7, wherein the detents are positioned on the bracket member at an inner end of the drawer bracket member that faces away from the cabinet opening.

9. The assembly of claim 2, wherein the track roller includes two angled side walls for respectively engaging the two slanted walls of the drawer bracket.

10. The assembly of claim 1, wherein the drawer bracket includes a pair of spaced detents extending downward into the groove adjacent a side of the drawer bracket and wherein the detents are spaced-apart so that the track roller may be positioned therebetween to locate the drawer bracket member in a secure position on the cabinet track member when the drawer is in its open position.

11. The assembly of claim 10, wherein the detents are positioned on the bracket member at an inner end of the drawer bracket member that faces away from the cabinet opening.

12. The assembly of claim 10, wherein the track roller includes two angled side walls for respectively engaging the two slanted walls of the drawer bracket.

13. A drawer slide assembly for horizontally guiding the opening and closing of a drawer from a cabinet comprising an elongated cabinet track member for attachment on a side wall of a cabinet, the cabinet track member including a track roller for fixedly attaching to the cabinet side wall so as to be supported by and rotatable about a horizontal axle, an elongated drawer bracket member for attachment on the drawer and nested within the elongated cabinet track member, the drawer bracket member including an inner side, an opposite outer side, and slanted walls transitioning to a vertex to form a groove receiving the track roller and extending between the inner and outer sides of the elongated drawer bracket, and the slanted walls of the drawer bracket member being formed to abut and glide on the track roller between a fully closed and a fully open position relative to the cabinet track member so that the weight of the drawer will be distributed to the track roller by the slanted walls to be vertically applied to the horizontal axle so as to be supported by the cabinet, and a bracket mount fixed on the drawer bracket at the outer side, the bracket mount including a bracket roller mounted for rotating on the cabinet track member and supported by and rotatable on a horizontal axle so that an axis of rotation of the bracket roller is substantially orthogonal to the horizontal movement of the drawer bracket member on the track roller.

14. The assembly of claim 13 wherein the drawer bracket includes a pair of spaced detents extending downward into the groove adjacent a side of the drawer bracket and wherein the detents are spaced-apart so that the track roller may be positioned therebetween to locate the drawer bracket member in a secure position on the cabinet track member when the drawer is in its open position.

* * * * *